US009976820B2

(12) United States Patent
Okazaki et al.

(10) Patent No.: US 9,976,820 B2
(45) Date of Patent: May 22, 2018

(54) STACKING-TYPE HEADER, HEAT EXCHANGER, AND AIR-CONDITIONING APPARATUS

(71) Applicant: Mitsubishi Electric Corporation, Tokyo (JP)

(72) Inventors: Takashi Okazaki, Tokyo (JP); Akira Ishibashi, Tokyo (JP); Takuya Matsuda, Tokyo (JP); Shinya Higashiiue, Tokyo (JP); Daisuke Ito, Tokyo (JP); Atsushi Mochizuki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days. days.

(21) Appl. No.: 14/784,703

(22) PCT Filed: May 15, 2013

(86) PCT No.: PCT/JP2013/063608
§ 371 (c)(1),
(2) Date: Oct. 15, 2015

(87) PCT Pub. No.: WO2014/184916
PCT Pub. Date: Nov. 20, 2014

(65) Prior Publication Data

US 2016/0076823 A1 Mar. 17, 2016

(51) Int. Cl.
*F28F 1/00* (2006.01)
*F28F 9/02* (2006.01)
(Continued)

(52) U.S. Cl.
CPC ..... *F28F 9/028* (2013.01); *F25B 39/00* (2013.01); *F28D 1/0476* (2013.01);
(Continued)

(58) Field of Classification Search
CPC ..... F28F 9/0221; F28F 9/0246; F28F 9/026; F28F 9/0265; F28F 9/0268; F28F 9/0278;
(Continued)

(56) References Cited

U.S. PATENT DOCUMENTS 5,163,507 A * 11/1992 Joshi ..... F28D 1/0435 165/135
5,186,246 A * 2/1993 Halstead ..... B60H 1/3227 165/140
(Continued)

FOREIGN PATENT DOCUMENTS

CN 203940658 U 11/2014
JP H03-194370 A 8/1991
(Continued)

OTHER PUBLICATIONS

Office Action dated Oct. 31, 2016 in the corresponding CN application No. 201380076097.8 (English translation attached).
(Continued)

*Primary Examiner* — Jason Thompson
(74) *Attorney, Agent, or Firm* — Posz Law Group, PLC

(57) ABSTRACT

A stacking-type header according to the present invention includes: a first plate-shaped unit; and a second plate-shaped unit, in which the first plate-shaped unit or the second plate-shaped unit comprises at least one plate-shaped member having formed therein: a flow passage formed in the first plate-shaped member through which the refrigerant passes to flow into the plurality of first inlet flow passages; and a flow passage formed in the second plate-shaped member through which the refrigerant passes to flow into the second inlet flow passage, and in which the at least one plate-shaped member has a through portion or a concave portion formed in at least a part of a region between the flow passage through which the refrigerant passes to flow into the plurality of first inlet flow passages and the flow passage
(Continued)

through which the refrigerant passes to flow into the second inlet flow passage.

7 Claims, 7 Drawing Sheets

(51) Int. Cl.

| | |
|---|---|
| ***F28D 1/047*** | (2006.01) |
| ***F28D 1/053*** | (2006.01) |
| ***F25B 39/00*** | (2006.01) |
| ***F28F 9/22*** | (2006.01) |
| *F28D 21/00* | (2006.01) |

(52) U.S. Cl.
CPC ..... *F28D 1/05383* (2013.01); *F28F 9/0221* (2013.01); *F28F 9/0278* (2013.01); *F28F 9/22* (2013.01); *F28D 2021/007* (2013.01); *F28D 2021/0071* (2013.01)

(58) Field of Classification Search
CPC .. F28F 9/0275; F28F 2210/02; F28F 2270/00; F28D 1/0475; F28D 27/02; F28D 1/05308; F28D 1/05366; F28D 1/05375; F28D 1/05391
USPC ..... 165/174, 173
See application file for complete search history.

(56) References Cited

U.S. PATENT DOCUMENTS 5,241,839 A * 9/1993 Hughes ..... B60H 1/3227 165/174
5,242,016 A * 9/1993 Voss ..... F25B 39/028 165/173
5,388,635 A * 2/1995 Gruber ..... F28F 3/12 165/185
6,681,843 B2 * 1/2004 Sugito ..... F28D 15/0233 165/104.21
6,892,805 B1 * 5/2005 Valensa ..... F28F 9/0278 165/173
2002/0080563 A1 * 6/2002 Pence ..... B01F 5/06 361/676
2002/0088612 A1 * 7/2002 Gotou ..... F28D 9/0062 165/166
2003/0024690 A1 2/2003 Sugito
2003/0213580 A1 * 11/2003 Philpott ..... F28F 3/04 165/46
2005/0006081 A1 * 1/2005 Kamiyama ..... F28D 1/0443 165/174
2005/0039901 A1 * 2/2005 Demuth ..... F28D 1/0478 165/175
2007/0119431 A1 * 5/2007 Harada ..... F02B 29/0456 123/563
2010/0314087 A1 * 12/2010 Daly ..... F25J 1/0022 165/168
2013/0174924 A1 * 7/2013 Luo ..... F28F 9/0221 137/561 A
2016/0076823 A1 3/2016 Okazaki et al.

FOREIGN PATENT DOCUMENTS

JP H06-011291 A 1/1994
JP H07-318270 A 12/1995
JP H10-185485 A 7/1998
JP H11-030495 A 2/1999
JP H11-118295 A 4/1999
JP 2000-161818 A 6/2000
JP 2006-125652 A 5/2006
JP 2007-298197 A 11/2007

OTHER PUBLICATIONS

Extended European Search Report dated Dec. 5, 2016 issued in corresponding EP patent application No. 13884657.1.
Office Action dated Jan. 18, 2017 issued in corresponding KR patent application No. 10-2015-7032589 (and English translation).
International Search Report of the International Searching Authority dated Jul. 23, 2013 for the corresponding international application No. PCT/JP2013/063608 (and English translation).
Office Action dated Jul. 27, 2017 issued in corresponding KR patent application No. 10-2015-7032589 (and English translation).
Office Action dated Aug. 7, 2017 issued in corresponding EP patent application No. 13884657.1.
Office Action dated May 19, 2017 issued in corresponding CN patent application No. 201380076097.8 (and English translation).
Office Action dated Aug. 15, 2017 issued in corresponding CN patent application No. 201380076097.8 (and English translation).
Final Office Action dated Dec. 21, 2017 issued in corresponding KR patent application No. 10-2015-7032589 (and English translation).

* cited by examiner

STACKING-TYPE HEADER, HEAT EXCHANGER, AND AIR-CONDITIONING APPARATUS

CROSS REFERENCE TO RELATED APPLICATION

This application is a U.S. national stage application of PCT/JP2013/063608 filed on May 15, 2013, the contents of which are incorporated herein by reference.

TECHNICAL FIELD

The present invention relates to a stacking-type header, a heat exchanger, and an air-conditioning apparatus.

BACKGROUND ART

As a related-art stacking-type header, there is known a stacking-type header including a first plate-shaped unit having formed therein a plurality of outlet flow passages and a plurality of inlet flow passages, and a second plate-shaped unit stacked on the first plate-shaped unit and having formed therein an inlet flow passage communicating with the plurality of outlet flow passages formed in the first plate-shaped unit, and an outlet flow passage communicating with the plurality of inlet flow passages formed in the first plate-shaped unit (for example, see Patent Literature 1).

CITATION LIST

Patent Literature

Patent Literature 1: Japanese Unexamined Patent Application Publication No. 2000-161818 (paragraph [0032] to paragraph [0036], FIG. 7 & FIG. 8)

SUMMARY OF INVENTION

Technical Problem

In such a stacking-type header, for example, when superheated refrigerant flows into a part between the plurality of inlet flow passages of the first plate-shaped unit and the outlet flow passage of the second plate-shaped unit, the superheated refrigerant exchanges heat with low-temperature refrigerant flowing through a part between the plurality of outlet flow passages of the first plate-shaped unit and the inlet flow passage of the second plate-shaped unit. In other words, the related-art stacking-type header has a problem in that the heat exchange loss of the refrigerant is large.

The present invention has been made in view of the above-mentioned problem, and has an object to provide a stacking-type header reduced in heat exchange loss of refrigerant. Further, the present invention has an object to provide a heat exchanger including such a stacking-type header. Further, the present invention has an object to provide an air-conditioning apparatus including such a heat exchanger.

Solution to Problem

According to one embodiment of the present invention, there is provided a stacking-type header, including: a first plate-shaped unit having formed therein a plurality of first outlet flow passages and a plurality of first inlet flow passages; and a second plate-shaped unit stacked on the first plate-shaped unit, the second plate-shaped unit having formed therein: at least a part of a distribution flow passage configured to distribute refrigerant, which passes through a second inlet flow passage to flow into the second plate-shaped unit, to the plurality of first outlet flow passages to cause the refrigerant to flow out from the second plate-shaped unit; and at least a part of a joining flow passage configured to join together flows of the refrigerant, which pass through the plurality of first inlet flow passages to flow into the second plate-shaped unit, to cause the refrigerant to flow out toward a second outlet flow passage, in which the first plate-shaped unit or the second plate-shaped unit includes at least one plate-shaped member having formed therein: a flow passage through which the refrigerant passes to flow into the plurality of first inlet flow passages; and a flow passage through which the refrigerant passes to flow into the second inlet flow passage, and in which the at least one plate-shaped member has a through portion or a concave portion formed in at least a part of a region between the flow passage through which the refrigerant passes to flow into the plurality of first inlet flow passages and the flow passage through which the refrigerant passes to flow into the second inlet flow passage.

Advantageous Effects of Invention

In the stacking-type header according to the one embodiment of the present invention, the first plate-shaped unit or the second plate-shaped unit includes the at least one plate-shaped member having formed therein: the flow passage through which the refrigerant passes to flow into the first inlet flow passages; and the flow passage through which the refrigerant passes to flow into the second inlet flow passage. The through portion or the concave portion is formed in the plate-shaped member in at least a part of the region between the flow passage through which the refrigerant passes to flow into the first inlet flow passages and the flow passage through which the refrigerant passes to flow into the second inlet flow passage. Therefore, it is possible to suppress the heat exchange loss of the refrigerant.

DESCRIPTION OF EMBODIMENTS

Figure 1:
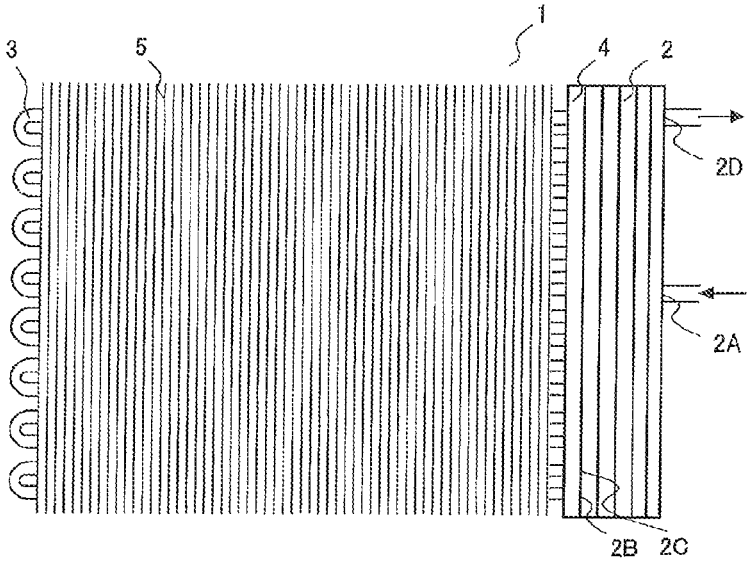
FIG. 1 is a view illustrating a configuration of a heat exchanger according to Embodiment 1.

Now, a stacking-type header according to the present invention is described with reference to the drawings.

Note that, in the following, there is described a case where the stacking-type header according to the present invention distributes refrigerant flowing into a heat exchanger, but the stacking-type header according to the present invention may distribute refrigerant flowing into other devices. Further, the configuration, operation, and other matters described below are merely examples, and the present invention is not limited to such configuration, operation, and other matters. Further, in the drawings, the same or similar components are denoted by the same reference symbols, or the reference symbols therefor are omitted. Further, the illustration of details in the structure is appropriately simplified or omitted. Further, overlapping description or similar description is appropriately simplified or omitted.

Embodiment 1

A heat exchanger according to Embodiment 1 is described.

<Configuration of Heat Exchanger>

Now, the configuration of the heat exchanger according to Embodiment 1 is described.

FIG. 1 is a view illustrating the configuration of the heat exchanger according to Embodiment 1.

As illustrated in FIG. 1, a heat exchanger 1 includes a stacking-type header 2, a plurality of first heat transfer tubes 3, a retaining member 4, and a plurality of fins 5.

The stacking-type header 2 includes a refrigerant inflow port 2A, a plurality of refrigerant outflow ports 2B, a plurality of refrigerant inflow ports 2C, and a refrigerant outflow port 2D. Refrigerant pipes are connected to the refrigerant inflow port 2A of the stacking-type header 2 and the refrigerant outflow port 2D of the stacking-type header 2. The first heat transfer tube 3 is a flat tube subjected to hair-pin bending. The plurality of first heat transfer tubes 3 are connected between the plurality of refrigerant outflow ports 2B of the stacking-type header 2 and the plurality of refrigerant inflow ports 2C of the stacking-type header 2.

The first heat transfer tube 3 is a flat tube having a plurality of flow passages formed therein. The first heat transfer tube 3 is made of, for example, aluminum. Both ends of the plurality of first heat transfer tubes 3 are connected to the plurality of refrigerant outflow ports 2B and the plurality of refrigerant inflow ports 2C of the stacking-type header 2 under a state in which both the ends are retained by the plate-shaped retaining member 4. The retaining member 4 is made of, for example, aluminum. The plurality of fins 5 are joined to the first heat transfer tubes 3. The fin 5 is made of, for example, aluminum. It is preferred that the first heat transfer tubes 3 and the fins 5 be joined by brazing. Note that, in FIG. 1, there is illustrated a case where eight first heat transfer tubes 3 are provided, but the present invention is not limited to such a case.

<Flow of Refrigerant in Heat Exchanger>

Now, the flow of the refrigerant in the heat exchanger according to Embodiment 1 is described.

The refrigerant flowing through the refrigerant pipe passes through the refrigerant inflow port 2A to flow into the stacking-type header 2 to be distributed, and then passes through the plurality of refrigerant outflow ports 2B to flow out toward the plurality of first heat transfer tubes 3. In the plurality of first heat transfer tubes 3, the refrigerant exchanges heat with air supplied by a fan, for example. The refrigerant flowing through the plurality of first heat transfer tubes 3 passes through the plurality of refrigerant inflow ports 2C to flow into the stacking-type header 2 to be joined, and then passes through the refrigerant outflow port 2D to flow out toward the refrigerant pipe. The refrigerant can reversely flow.

<Configuration of Laminated Header>

Now, the configuration of the stacking-type header of the heat exchanger according to Embodiment 1 is described.

Figure 2:
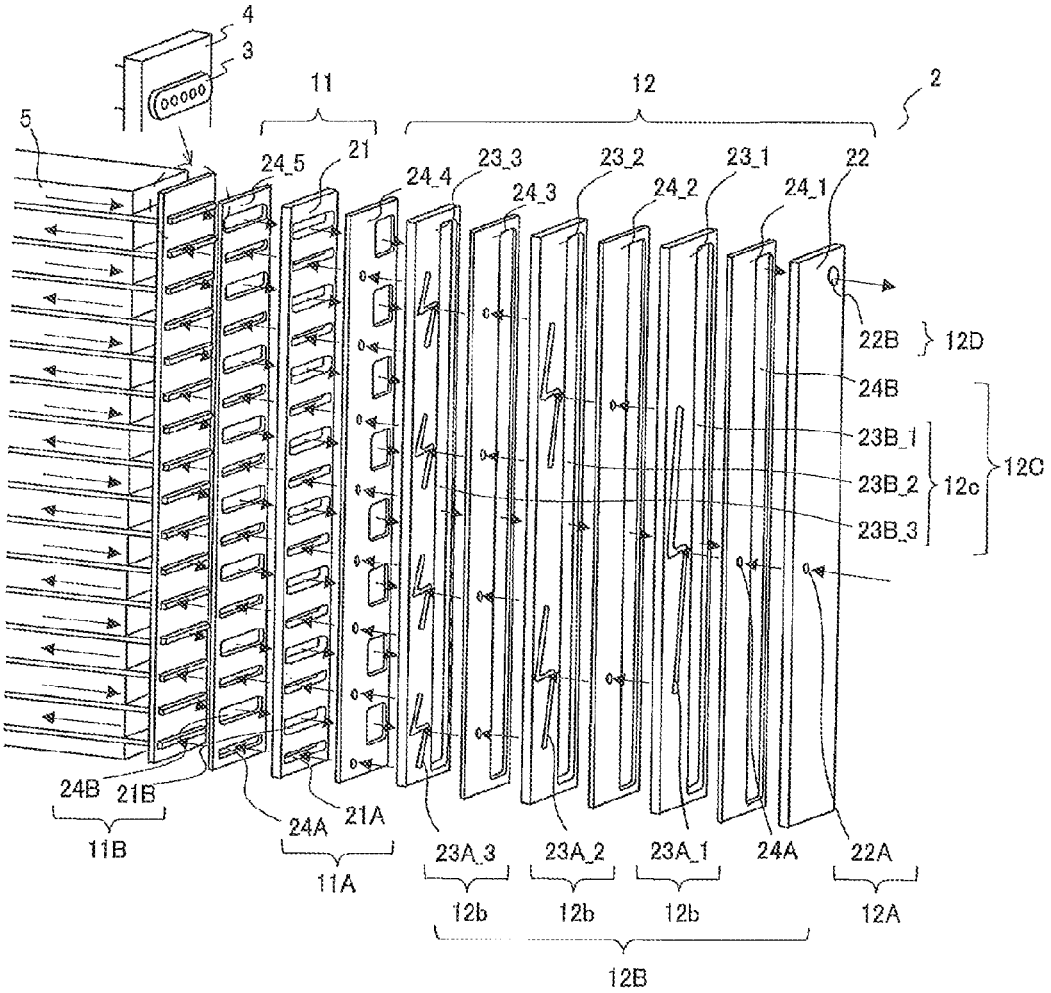
FIG. 2 is a perspective view illustrating the heat exchanger according to Embodiment 1 under a state in which a stacking-type header is disassembled.
Figure 3:
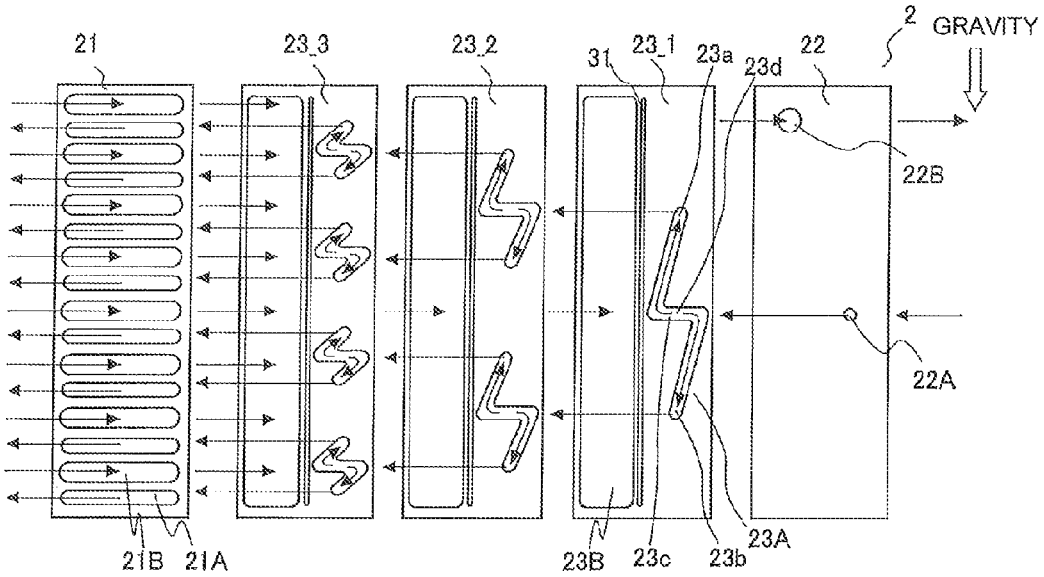
FIG. 3 is a developed view of the stacking-type header of the heat exchanger according to Embodiment 1.

FIG. 2 is a perspective view illustrating the heat exchanger according to Embodiment 1 under a state in which the stacking-type header is disassembled. FIG. 3 is a developed view of the stacking-type header of the heat exchanger according to Embodiment 1. Note that, in FIG. 2, the illustration of a first heat insulating slit 31 is omitted. Further, in FIG. 3, the illustration of a both-side clad member 24 is omitted.

As illustrated in FIG. 2 and FIG. 3, the stacking-type header 2 includes a first plate-shaped unit 11 and a second plate-shaped unit 12. The first plate-shaped unit 11 and the second plate-shaped unit 12 are stacked on each other.

The first plate-shaped unit 11 is stacked on the refrigerant outflow side. The first plate-shaped unit 11 includes a first plate-shaped member 21. The first plate-shaped unit 11 has formed therein a plurality of first outlet flow passages 11A and a plurality of first inlet flow passage 11B. The plurality of first outlet flow passages 11A correspond to the plurality of refrigerant outflow ports 2B in FIG. 1. The plurality of first inlet flow passages 11B correspond to the plurality of refrigerant inflow ports 2C in FIG. 1.

The first plate-shaped member 21 has formed therein a plurality of flow passages 21A and a plurality of flow passages 21B. The plurality of flow passages 21A and the plurality of flow passages 21B are each a through hole having an inner peripheral surface shaped conforming to an outer peripheral surface of the first heat transfer tube 3. When the first plate-shaped member 21 is stacked, the plurality of flow passages 21A function as the plurality of first outlet flow passages 11A, and the plurality of flow passages 21B function as the plurality of first inlet flow passages 11B. The first plate-shaped member 21 has a thickness of about 1 mm to 10 mm, and is made of aluminum, for example. When the plurality of flow passages 21A and 21B are formed by press working or other processing, the work is simplified, and the manufacturing cost is reduced.

The second plate-shaped unit 12 is stacked on the refrigerant inflow side. The second plate-shaped unit 12 includes a second plate-shaped member 22 and a plurality of third plate-shaped members 23_1 to 23_3. The second plate-shaped unit 12 has formed therein a second inlet flow passage 12A, a distribution flow passage 12B, a joining flow passage 12C, and a second outlet flow passage 12D. The distribution flow passage 12B includes a plurality of branching flow passages 12*b*. The joining flow passage 12C includes a mixing flow passage 12*c*. The second inlet flow passage 12A corresponds to the refrigerant inflow port 2A in FIG. 1. The second outlet flow passage 12D corresponds to the refrigerant outflow port 2D in FIG. 1.

Note that, a part of the distribution flow passage 12B or a part of the joining flow passage 12C may be formed in the first plate-shaped unit 11. In such a case, a flow passage may be formed in the first plate-shaped member 21, the second plate-shaped members 22, the plurality of third plate-shaped members 23_1 to 23_3, or other members, for turning back the refrigerant flowing therein to cause the refrigerant to flow out therefrom. When the flow passage for turning back the refrigerant flowing therein to cause the refrigerant to flow out therefrom is not formed, and the whole distribution flow passage 12B or the whole joining flow passage 12C is formed in the second plate-shaped unit 12, a width dimension of the stacking-type header 2 can be substantially equal to a width dimension of the first heat transfer tube 3, which achieves compactification of the heat exchanger 1.

The second plate-shaped member 22 has a flow passage 22A and a flow passage 22B formed therein. The flow passage 22A and the flow passage 22B are each a circular through hole. When the second plate-shaped member 22 is stacked, the flow passage 22A functions as the second inlet flow passage 12A and the flow passage 22B functions as the second outlet flow passage 12D. The second plate-shaped member 22 has a thickness of about 1 mm to 10 mm, and is made of aluminum, for example. When the flow passage 22A and the flow passage 22B are each formed by press working or other processing, the work is simplified, and the manufacturing cost and the like are reduced.

For example, fittings or other such components are provided on the surface of the second plate-shaped member 22 on the side on which other members are not stacked, and the refrigerant pipes are connected to the second inlet flow passage 12A and the second outlet flow passage 12D through the fittings or other such components, respectively. The inner peripheral surfaces of the second inlet flow passage 12A and the second outlet flow passage 12D may be shaped to be fitted to the outer peripheral surfaces of the refrigerant pipes so that the refrigerant pipes may be directly connected to the second inlet flow passage 12A and the second outlet flow passage 12D without using the fittings or other such components. In such a case, the component cost and the like are reduced.

The plurality of third plate-shaped members 23_1 to 23_3 respectively have a plurality of flow passages 23A_1 to 23A_3 formed therein. The plurality of flow passages 23A_1 to 23A_3 are each a through groove having two end portions 23*a* and 23*b*. When the plurality of third plate-shaped members 23_1 to 23_3 are stacked, each of the plurality of flow passages 23A_1 to 23A_3 functions as the branching flow passage 12*b*. The plurality of third plate-shaped members 23_1 to 23_3 each have a thickness of about 1 mm to 10 mm, and are made of aluminum, for example. When the plurality of flow passages 23A_1 to 23A_3 are formed by press working or other processing, the work is simplified, and the manufacturing cost and the like are reduced.

Further, the plurality of third plate-shaped members 23_1 to 23_3 respectively have a plurality of flow passages 23B_1 to 23B_3 formed therein. The plurality of flow passages 23B_1 to 23B_3 are each a rectangular through hole passing through substantially the entire region in the height direction of each of the third plate-shaped members 23_1 to 23_3. When the plurality of third plate-shaped members 23_1 to 23_3 are stacked, each of the plurality of flow passages 23B_1 to 23B_3 functions as a part of the mixing flow passage 12*c*. The plurality of flow passages 23B_1 to 23B_3 may not have a rectangular shape.

In the following, in some cases, the plurality of third plate-shaped members 23_1 to 23_3 are collectively referred to as the third plate-shaped member 23. In the following, in some cases, the plurality of flow passages 23A_1 to 23A_3 are collectively referred to as the flow passage 23A. In the following, in some cases, the plurality of flow passages 23B_1 to 23B_3 are collectively referred to as the flow passage 23B. In the following, in some cases, the retaining member 4, the first plate-shaped member 21, the second plate-shaped member 22, and the third plate-shaped member 23 are collectively referred to as the plate-shaped member.

The flow passage 23A formed in the third plate-shaped member 23 has a shape in which the two end portions 23*a* and 23*b* are connected to each other through a straight-line part 23*c* perpendicular to the gravity direction. The branching flow passage 12*b* is formed by closing, by a member stacked adjacent on the refrigerant inflow side, the flow passage 23A in a region other than a partial region 23*d* (hereinafter referred to as "opening port 23*d*") between both ends of the straight-line part 23*c*, and closing, by a member stacked adjacent on the refrigerant outflow side, the flow passage 23A in a region other than the end portion 23*a* and the end portion 23*b*.

In order to branch the refrigerant flowing into the flow passage to have different heights and cause the refrigerant to flow out therefrom, the end portion 23*a* and the end portion 23*b* are positioned at heights different from each other. In particular, when one of the end portion 23*a* and the end portion 23*b* is positioned on the upper side relative to the straight-line part 23*c*, and the other thereof is positioned on the lower side relative to the straight-line part 23*c*, each distance from the opening port 23*d* along the flow passage 23A to each of the end portion 23*a* and the end portion 23*b* can be less biased without complicating the shape. When the straight line connecting between the end portion 23*a* and the end portion 23*b* is set parallel to the longitudinal direction of the third plate-shaped member 23, the dimension of the third plate-shaped member 23 in the transverse direction can be decreased, which reduces the component cost, the weight, and the like. Further, when the straight line connecting between the end portion 23*a* and the end portion 23*b* is set parallel to the array direction of the first heat transfer tubes 3, space saving can be achieved in the heat exchanger 1.

The branching flow passage 12*b* branches the refrigerant flowing therein into two flows to cause the refrigerant to flow out therefrom. Therefore, when the number of the first heat transfer tubes 3 to be connected is eight, at least three third plate-shaped members 23 are required. When the number of the first heat transfer tubes 3 to be connected is sixteen, at least four third plate-shaped members 23 are required. The number of the first heat transfer tubes 3 to be connected is not limited to powers of 2. In such a case, the branching flow passage 12*b* and a non-branching flow passage may be combined with each other. Note that, the number of the first heat transfer tubes 3 to be connected may be two.

Note that, the stacking-type header 2 is not limited to a stacking-type header in which the plurality of first outlet flow passages 11A and the plurality of first inlet flow passage 11B are arrayed along the gravity direction, and may be used in a case where the heat exchanger 1 is installed in an inclined manner, such as a heat exchanger for a wall-mounting type room air-conditioning apparatus indoor unit, an outdoor unit for an air-conditioning apparatus, or a chiller outdoor unit. In such a case, the straight-line part 23*c* may be formed as a through groove shaped so that the straight-line part 23*c* is not perpendicular to the longitudinal direction of the third plate-shaped member 23.

Further, the flow passage 23A may have a different shape. For example, the flow passage 23A may not have the straight-line part 23*c*. In such a case, a horizontal part between the end portion 23*a* and the end portion 23*b* of the flow passage 23A, which is substantially perpendicular to the gravity direction, serves as the opening port 23*d*. In a case where the flow passage 23A has the straight-line part 23*c*, the influence of the gravity is reduced when the refrigerant is branched at the opening port 23*d*. Further, for example, the flow passage 23A may be formed as a through groove shaped to branch regions for connecting both the ends of the straight-line part 23*c* respectively to the end portion 23*a* and the end portion 23*b*. When the branching flow passage 12*b* branches the refrigerant flowing therein into two flows, but does not further branch the branched refrigerant into a plurality of flows, the uniformity in distribution of the refrigerant can be improved. The regions for connecting both the ends of the straight-line part 23*c* respectively to the end portion 23*a* and the end portion 23*b* may each be a straight line or a curved line.

The respective plate-shaped members are stacked by brazing. A both-side clad member having a brazing material rolled on both surfaces thereof may be used for all of the plate-shaped members or alternate plate-shaped members to supply the brazing material for joining. A one-side clad member having a brazing material rolled on one surface thereof may be used for all of the plate-shaped members to supply the brazing material for joining. A brazing-material sheet may be stacked between the respective plate-shaped members to supply the brazing material. A paste brazing material may be applied between the respective plate-shaped members to supply the brazing material. A both-side clad member having a brazing material rolled on both surfaces thereof may be stacked between the respective plate-shaped members to supply the brazing material.

Through lamination with use of brazing, the plate-shaped members are stacked without a gap therebetween, which suppresses leakage of the refrigerant and further secures the pressure resistance. When the plate-shaped members are pressurized during brazing, the occurrence of brazing failure is further suppressed. When processing that promotes formation of a fillet, such as forming a rib at a position at which leakage of the refrigerant is liable to occur, is performed, the occurrence of brazing failure is further suppressed.

Further, when all of the members to be subjected to brazing, including the first heat transfer tube 3 and the fin 5, are made of the same material (for example, made of aluminum), the members may be collectively subjected to brazing, which improves the productivity. After the brazing in the stacking-type header 2 is performed, the brazing of the first heat transfer tube 3 and the fin 5 may be performed. Further, only the first plate-shaped unit 11 may be first joined to the retaining member 4 by brazing, and the second plate-shaped unit 12 may be joined by brazing thereafter.

In particular, a plate-shaped member having a brazing material rolled on both surfaces thereof, in other words, a both-side clad member may be stacked between the respective plate-shaped members to supply the brazing material. As illustrated in FIG. 2, a plurality of both-side clad members 24_1 to 24_5 are stacked between the respective plate-shaped members. In the following, in some cases, the plurality of both-side clad members 24_1 to 24_5 are collectively referred to as the both-side clad member 24.

The both-side clad member 24 has a flow passage 24A and a flow passage 24B formed therein, which pass through the both-side clad member 24. When the flow passage 24A and the flow passage 24B are formed by press working or other processing, the work is simplified, and the manufacturing cost and the like are reduced. When all of the members to be subjected to brazing, including the both-side clad member 24, are made of the same material (for example, made of aluminum), the members may be collectively subjected to brazing, which improves the productivity.

The flow passage 24A formed in the both-side clad member 24 stacked on each of the second plate-shaped member 22 and the third plate-shaped member 23 is a circular through hole. The flow passage 24B formed in the both-side clad member 24 stacked on each of the third plate-shaped members 23_1 and 23_2 is a rectangular through hole passing through substantially the entire region in the height direction of the both-side clad member 24. The flow passage 24B may not have a rectangular shape. The plurality of flow passages 24B formed in the both-side clad member 24_4 stacked between the third plate-shaped member 23_3 and the first plate-shaped member 21 are each a rectangular through hole. The plurality of flow passages 24B may not each have a rectangular shape.

The plurality of flow passages 24A and the plurality of flow passages 24B formed in the both-side clad member 24_5 stacked between the first plate-shaped member 21 and the retaining member 4 are each a through hole having an inner peripheral surface shaped conforming to the outer peripheral surface of the first heat transfer tube 3.

When the both-side clad member 24 is stacked, the flow passage 24A functions as a refrigerant partitioning flow passage for the first outlet flow passage 11A, the distribution flow passage 12B, and the second inlet flow passage 12A, whereas the flow passage 24B functions as a refrigerant partitioning flow passage for the first inlet flow passage 11B, the joining flow passage 12C, and the second outlet flow passage 12D. Through formation of the refrigerant partitioning flow passage by the both-side clad member 24, the flows of refrigerant can be reliably partitioned from each other. Further, when the flows of the refrigerant can be reliably partitioned from each other, the degree of freedom in design of the flow passage can be increased. Note that, the both-side clad member 24 may be stacked between a part of the plate-shaped members, and a brazing material may be supplied between the remaining plate-shaped members by other methods.

End portions of the first heat transfer tube 3 are projected from a surface of the retaining member 4. When the both-side clad member 24_5 is stacked on the retaining member 4 so that the inner peripheral surfaces of the flow passages 24A and 24B of the both-side clad member 24_5 are fitted to the outer peripheral surfaces of the respective end portions of the first heat transfer tube 3, the first heat transfer tube 3 is connected to each of the first outlet flow passage 11A and the first inlet flow passage 11B. The first heat transfer tube 3 and each of the first outlet flow passage 11A and the first inlet flow passage 11B may be positioned through, for example, fitting between a convex portion formed in the retaining member 4 and a concave portion formed in the first plate-shaped unit 11. In such a case, the end portions of the first heat transfer tube 3 may not be projected from the surface of the retaining member 4. The retaining member 4 may be omitted so that the first heat transfer tube 3 is directly connected to each of the first outlet flow passage 11A and the first inlet flow passage 11B. In such a case, the component cost and the like are reduced.

As illustrated in FIG. 3, the first heat insulating slit 31 is formed between the flow passage 23A and the flow passage 23B of the third plate-shaped member 23. The first heat insulating slit 31 may pass through the third plate-shaped member 23 or may be a bottomed concave portion that does not pass through the third plate-shaped member 23. The first heat insulating slit 31 may be formed in one row or in a plurality of rows. The first heat insulating slit 31 may be a straight line or a curved line. The first heat insulating slit 31 may be a plurality of hole portions formed intermittently. The hole portions each have a circular shape or an elongated hole shape, for example. A heat insulating material may be charged in the first heat insulating slit 31. When the first heat insulating slit 31 passes through the third plate-shaped member 23 and is formed by press working or other processing, the work is simplified, and the manufacturing cost is reduced. Further, the heat exchange between the refrigerant passing through the flow passage 23A and the refrigerant passing through the flow passage 23B can be reliably suppressed.

The first heat insulating slit 31 may be formed in a different plate-shaped member or the both-side clad member 24 in a region between the flow passage through which the refrigerant passes to flow into the first inlet flow passage 11B and the flow passage through which the refrigerant passes to flow into the second inlet flow passage 12A. In other words, the first heat insulating slit 31 may be formed in the first plate-shaped member 21 in a region between the flow passage 21B and the flow passage 21A. Further, the first heat insulating slit 31 may be formed in the second plate-shaped member 22 in a region between the flow passage 22B and the flow passage 22A. Further, the first heat insulating slit 31 may be formed in the both-side clad member 24 in a region between the flow passage 24B and the flow passage 24A.

<Flow of Refrigerant in Laminated Header>

Now, the flow of the refrigerant in the stacking-type header of the heat exchanger according to Embodiment 1 is described.

As illustrated in FIG. 2 and FIG. 3, the refrigerant passing through the flow passage 22A of the second plate-shaped member 22 flows into the opening port 23*d* of the flow passage 23A formed in the third plate-shaped member 23_1. The refrigerant flowing into the opening port 23*d* hits against the surface of the member stacked adjacent to the third plate-shaped member 23_1, and is branched into two flows respectively toward both the ends of the straight-line part 23*c*. The branched refrigerant reaches each of the end portions 23*a* and 23*b* of the flow passage 23A, and flows into the opening port 23*d* of the flow passage 23A formed in the third plate-shaped member 23_2.

Similarly, the refrigerant flowing into the opening port 23*d* of the flow passage 23A formed in the third plate-shaped member 23_2 hits against the surface of the member stacked adjacent to the third plate-shaped member 23_2, and is branched into two flows respectively toward both the ends of the straight-line part 23*c*. The branched refrigerant reaches each of the end portions 23*a* and 23*b* of the flow passage 23A, and flows into the opening port 23*d* of the flow passage 23A formed in the third plate-shaped member 23_3.

Similarly, the refrigerant flowing into the opening port 23*d* of the flow passage 23A formed in the third plate-shaped member 23_3 hits against the surface of the member stacked adjacent to the third plate-shaped member 23_3, and is branched into two flows respectively toward both the ends of the straight-line part 23*c*. The branched refrigerant reaches each of the end portions 23*a* and 23*b* of the flow passage 23A, and passes through the flow passage 21A of the first plate-shaped member 21 to flow into the first heat transfer tube 3.

The refrigerant flowing out from the flow passage 21A of the first plate-shaped member 21 to pass through the first heat transfer tube 3 flows into the flow passage 21B of the first plate-shaped member 21. The refrigerant flowing into the flow passage 21B of the first plate-shaped member 21 flows into the flow passage 23B formed in the third plate-shaped member 23 to be mixed. The mixed refrigerant passes through the flow passage 22B of the second plate-shaped member 22 to flow out therefrom toward the refrigerant pipe.

<Usage Mode of Heat Exchanger>

Now, an example of a usage mode of the heat exchanger according to Embodiment 1 is described.

Note that, in the following, there is described a case where the heat exchanger according to Embodiment 1 is used for an air-conditioning apparatus, but the present invention is not limited to such a case, and for example, the heat exchanger according to Embodiment 1 may be used for other refrigeration cycle apparatus including a refrigerant circuit. Further, there is described a case where the air-conditioning apparatus switches between a cooling operation and a heating operation, but the present invention is not limited to such a case, and the air-conditioning apparatus may perform only the cooling operation or the heating operation.

Figure 4:
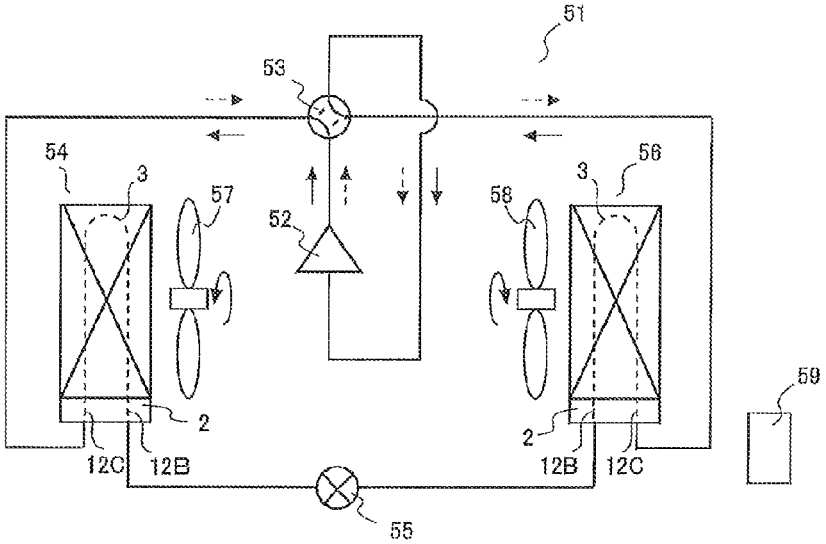
FIG. 4 is a diagram illustrating a configuration of an air-conditioning apparatus to which the heat exchanger according to Embodiment 1 is applied.

FIG. 4 is a view illustrating the configuration of the air-conditioning apparatus to which the heat exchanger according to Embodiment 1 is applied. Note that, in FIG. 4, the flow of the refrigerant during the cooling operation is indicated by the solid arrow, while the flow of the refrigerant during the heating operation is indicated by the dotted arrow.

As illustrated in FIG. 4, an air-conditioning apparatus 51 includes a compressor 52, a four-way valve 53, a heat source-side heat exchanger 54, an expansion device 55, a load-side heat exchanger 56, a heat source-side fan 57, a load-side fan 58, and a controller 59. The compressor 52, the four-way valve 53, the heat source-side heat exchanger 54, the expansion device 55, and the load-side heat exchanger 56 are connected by refrigerant pipes to form a refrigerant circuit.

The controller 59 is connected to, for example, the compressor 52, the four-way valve 53, the expansion device 55, the heat source-side fan 57, the load-side fan 58, and various sensors. The controller 59 switches the flow passage of the four-way valve 53 to switch between the cooling operation and the heating operation. The heat source-side heat exchanger 54 acts as a condensor during the cooling operation, and acts as an evaporator during the heating operation. The load-side heat exchanger 56 acts as the evaporator during the cooling operation, and acts as the condensor during the heating operation.

The flow of the refrigerant during the cooling operation is described.

The refrigerant in a high-pressure and high-temperature gas state discharged from the compressor 52 passes through the four-way valve 53 to flow into the heat source-side heat exchanger 54, and is condensed through heat exchange with the outside air supplied by the heat source-side fan 57, to thereby become the refrigerant in a high-pressure liquid state, which flows out from the heat source-side heat exchanger 54. The refrigerant in the high-pressure liquid state flowing out from the heat source-side heat exchanger 54 flows into the expansion device 55 to become the refrigerant in a low-pressure two-phase gas-liquid state. The refrigerant in the low-pressure two-phase gas-liquid state flowing out from the expansion device 55 flows into the load-side heat exchanger 56 to be evaporated through heat exchange with indoor air supplied by the load-side fan 58, to thereby become the refrigerant in a low-pressure gas state, which flows out from the load-side heat exchanger 56. The refrigerant in the low-pressure gas state flowing out from the load-side heat exchanger 56 passes through the four-way valve 53 to be sucked into the compressor 52.

The flow of the refrigerant during the heating operation is described.

The refrigerant in a high-pressure and high-temperature gas state discharged from the compressor 52 passes through the four-way valve 53 to flow into the load-side heat exchanger 56, and is condensed through heat exchange with the indoor air supplied by the load-side fan 58, to thereby become the refrigerant in a high-pressure liquid state, which flows out from the load-side heat exchanger 56. The refrigerant in the high-pressure liquid state flowing out from the load-side heat exchanger 56 flows into the expansion device 55 to become the refrigerant in a low-pressure two-phase gas-liquid state. The refrigerant in the low-pressure two-phase gas-liquid state flowing out from the expansion device 55 flows into the heat source-side heat exchanger 54 to be evaporated through heat exchange with the outside air supplied by the heat source-side fan 57, to thereby become the refrigerant in a low-pressure gas state, which flows out from the heat source-side heat exchanger 54. The refrigerant in the low-pressure gas state flowing out from the heat source-side heat exchanger 54 passes through the four-way valve 53 to be sucked into the compressor 52.

The heat exchanger 1 is used for at least one of the heat source-side heat exchanger 54 or the load-side heat exchanger 56. When the heat exchanger 1 acts as the evaporator, the heat exchanger 1 is connected so that the refrigerant passes through the distribution flow passage 12B of the stacking-type header 2 to flow into the first heat transfer tube 3, and the refrigerant passes through the first heat transfer tube 3 to flow into the joining flow passages 12C of the stacking-type header 2. In other words, when the heat exchanger 1 acts as the evaporator, the refrigerant in the two-phase gas-liquid state passes through the refrigerant pipe to flow into the distribution flow passage 12B of the stacking-type header 2, and the refrigerant in the gas state passes through the first heat transfer tube 3 to flow into the joining flow passages 12C of the stacking-type header 2. Further, when the heat exchanger 1 acts as the condensor, the refrigerant in the gas state passes through the refrigerant pipe to flow into the joining flow passages 12C of the stacking-type header 2, and the refrigerant in the liquid state passes through the first heat transfer tube 3 to flow into the distribution flow passage 12B of the stacking-type header 2.

<Action of Heat Exchanger>

Now, an action of the heat exchanger according to Embodiment 1 is described. In the stacking-type header 2, the first heat insulating slit 31 is formed in the plate-shaped member or the both-side clad member 24 in a region between the flow passage through which the refrigerant passes to flow into the first inlet flow passage 11B and the flow passage through which the refrigerant passes to flow into the second inlet flow passage 12A. Therefore, in the stacking-type header 2, the heat exchange between the refrigerant flowing into the first inlet flow passage 11B and the refrigerant flowing into the second inlet flow passage 12A is suppressed.

Further, the flow passage through which the refrigerant passes to flow into the first inlet flow passage 11B is required to have a large flow passage area in order to reduce the pressure loss caused when the refrigerant in a gas state flows into the flow passage. When the first heat insulating slit 31 is formed as in the stacking-type header 2, the heat exchange between the refrigerant flowing into the first inlet flow passage 11B and the refrigerant flowing into the second inlet flow passage 12A is suppressed, and accordingly, it is possible to reduce the interval between the flow passage through which the refrigerant passes to flow into the first inlet flow passage 11B and the flow passage through which the refrigerant passes to flow into the second inlet flow passage 12A so that the flow passage through which the refrigerant passes to flow into the first inlet flow passage 11B can have a large flow passage area, which improves the performance of the stacking-type header 2.

Further, in the stacking-type header 2, the first heat insulating slit 31 is formed in the third plate-shaped member 23 in a region between the flow passage 23A and the flow passage 23B. When the flow passage 23A of the third plate-shaped member 23 includes the straight-line part 23*c* perpendicular to the gravity direction, and causes the refrigerant to flow into a part between both the ends of the straight-line part 23*c* to be branched, the straight-line part 23*c* is required to have a large length in order to improve the uniformity in branching. When the first heat insulating slit 31 is formed between the flow passage 23A and the flow passage 23B as in the stacking-type header 2, the heat exchange between the refrigerant flowing into the first inlet flow passage 11B and the refrigerant flowing into the second inlet flow passage 12A is suppressed, and accordingly, it is possible to reduce the interval between the flow passage 23A and the flow passage 23B so that the straight-line part 23*c* of the flow passage 23A of the third plate-shaped member 23 can have a large length, which improves the uniformity in distribution of the refrigerant in the stacking-type header 2.

In particular, even when the stacking-type header 2 is used under a state in which the superheated refrigerant in a gas state passes through the first heat transfer tube 3 to flow into the first inlet flow passage 11B and the refrigerant in a low-temperature two-phase gas-liquid state passes through the refrigerant pipe to flow into the second inlet flow passage 12A, in the stacking-type header 2, the heat exchange between the refrigerant flowing into the first inlet flow passage 11B and the refrigerant flowing into the second inlet flow passage 12A is suppressed.

In particular, in a case where the heat exchanger 1 is used as the heat source-side heat exchanger 54 or the load-side heat exchanger 56 of the air-conditioning apparatus 51, and, when the heat exchanger 1 acts as the evaporator, the heat exchanger 1 is connected so that the distribution flow passage 12B causes the refrigerant to flow out from the first outlet flow passage 11A, when the heat exchanger 1 acts as the evaporator, in the stacking-type header 2, the heat exchange between the superheated refrigerant in a gas state flowing into the first inlet flow passage 11B and the refrigerant in a low-temperature two-phase gas-liquid state flowing into the second inlet flow passage 12A is suppressed. Further, when the heat exchanger 1 acts as the condensor, in the stacking-type header 2, the heat exchange between the refrigerant in a high-temperature gas state flowing into the second outlet flow passage 12D and the subcooled refrigerant in a liquid state flowing into the first outlet flow passage 11A is suppressed. Thus, the heat exchange performance of the heat exchanger 1 is improved so that the air-conditioning apparatus 51 has higher performance, for example.

In particular, in the related-art stacking-type header, when the heat transfer tube is changed from a circular tube to a flat tube for the purpose of reducing the refrigerant amount or achieving space saving in the heat exchanger, the stacking-type header is required to be upsized in the entire peripheral direction perpendicular to the refrigerant inflow direction. On the other hand, the stacking-type header 2 is not required to be upsized in the entire peripheral direction perpendicular to the refrigerant inflow direction, and thus space saving is achieved in the heat exchanger 1. In other words, in the related-art stacking-type header, when the heat transfer tube is changed from a circular tube to a flat tube, the sectional area of the flow passage in the heat transfer tube is reduced, and thus the pressure loss caused in the heat transfer tube is increased. Therefore, it is necessary to further reduce the angular interval between the plurality of grooves forming the branching flow passage to increase the number of paths (in other words, the number of heat transfer tubes), which causes upsize of the stacking-type header in the entire peripheral direction perpendicular to the refrigerant inflow direction. On the other hand, in the stacking-type header 2, even when the number of paths is required to be increased, the number of the third plate-shaped members 23 is only required to be increased, and hence the upsize of the stacking-type header 2 in the entire peripheral direction perpendicular to the refrigerant inflow direction is suppressed. Note that, the stacking-type header 2 is not limited to the case where the first heat transfer tube 3 is a flat tube.

Modified Example-1

Figure 5:
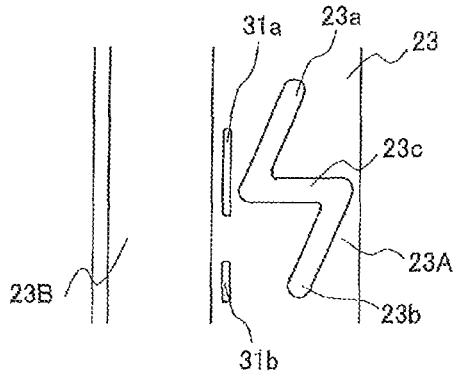
FIG. 5 is a view illustrating first heat insulating slits formed in a third plate-shaped member of Modified Example-1 of the heat exchanger according to Embodiment 1.

FIG. 5 is a view illustrating first heat insulating slits formed in the third plate-shaped member of Modified Example-1 of the heat exchanger according to Embodiment 1.

As illustrated in FIG. 5, the first heat insulating slit 31 formed in the third plate-shaped member 23 in a region between the flow passage 23A and the flow passage 23B may be formed only in a part of a region between the flow passage 23A and the flow passage 23B. In such a case, it is preferred that the first heat insulating slit 31 be formed only in a region where a periphery of the flow passage 23A and a periphery of the flow passage 23B are close to each other. For example, the first heat insulating slit 31 includes a first heat insulating slit 31*a* formed between the flow passage 23B and the straight-line part 23*c*, and a first heat insulating slit 31*b* formed between the flow passage 23B and the end portion 23*b* of the flow passage 23A, which communicates with the end portion of the straight-line part 23*c* located farther from the flow passage 23B. It is preferred that the first heat insulating slit 31*a* be formed between the flow passage 23B and a region in the flow passage 23A on the side closer to the straight-line part 23*c* between the straight-line part 23*c* and the end portion 23*a* communicating with the end portion of the straight-line part 23*c*, which is located closer to the flow passage 23B.

Modified Example-2

Figure 6:
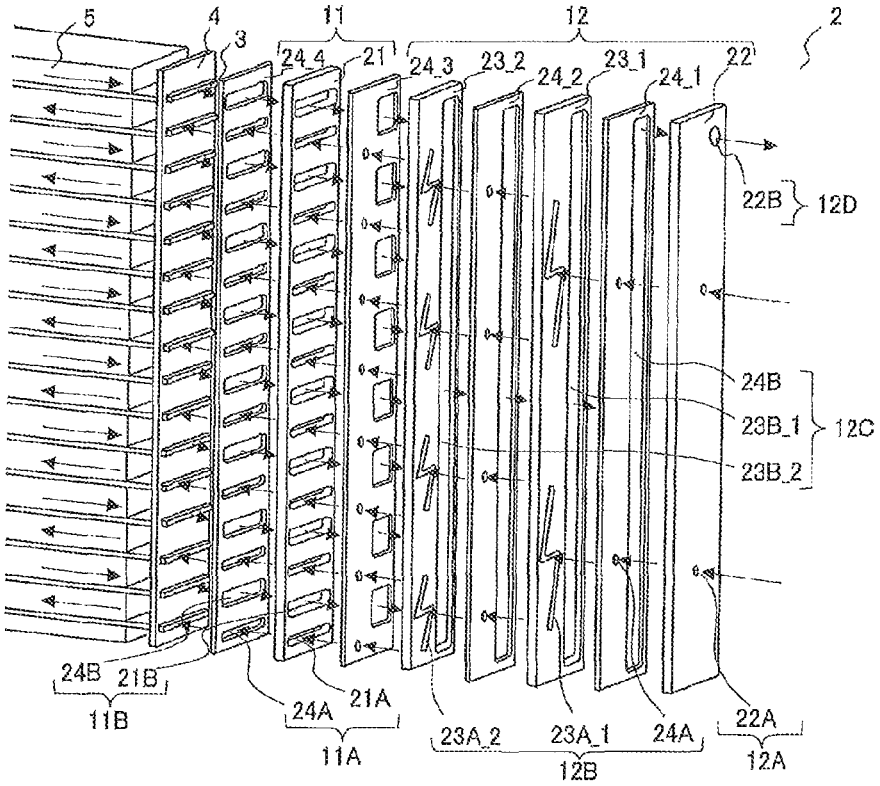
FIG. 6 is a perspective view of Modified Example-2 of the heat exchanger according to Embodiment 1 under a state in which the stacking-type header is disassembled.

FIG. 6 is a perspective view of Modified Example-2 of the heat exchanger according to Embodiment 1 under a state in which the stacking-type header is disassembled.

As illustrated in FIG. 6, the second plate-shaped member 22 may have the plurality of flow passages 22A formed therein, in other words, the second plate-shaped unit 12 may have the plurality of second inlet flow passages 12A formed therein, to thereby reduce the number of the third plate-shaped members 23. With such a configuration, the component cost, the weight, and the like can be reduced.

Modified Example-3

Figure 7:
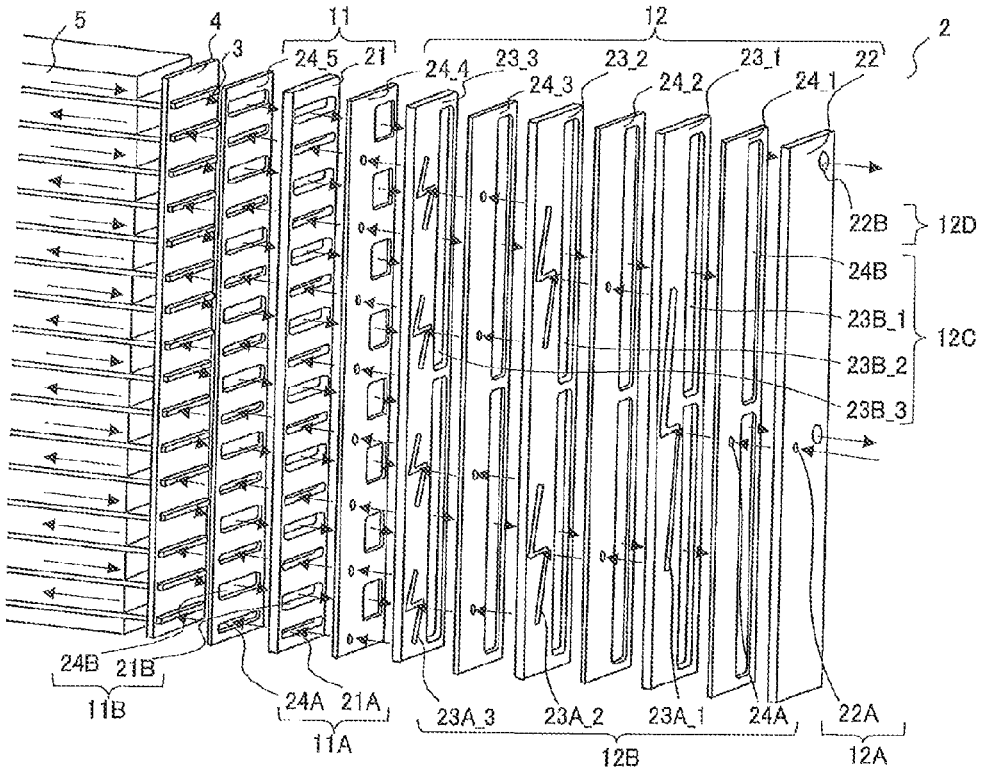
FIG. 7 is a perspective view of Modified Example-3 of the heat exchanger according to Embodiment 1 under a state in which the stacking-type header is disassembled.

FIG. 7 is a perspective view of Modified Example-3 of the heat exchanger according to Embodiment 1 under a state in which the stacking-type header is disassembled.

As illustrated in FIG. 7, the second plate-shaped member 22 and the third plate-shaped member 23 may respectively have the plurality of flow passages 22B and the plurality of flow passages 23B formed therein. In other words, the joining flow passage 12C may have the plurality of mixing flow passages 12*c*. The plurality of flow passages 24B of the both-side clad member 24 stacked between the second plate-shaped member 22 and the third plate-shaped member 23_3 have the same shape as the respective plurality of flow passages 23B.

Modified Example-4

Figure 8:
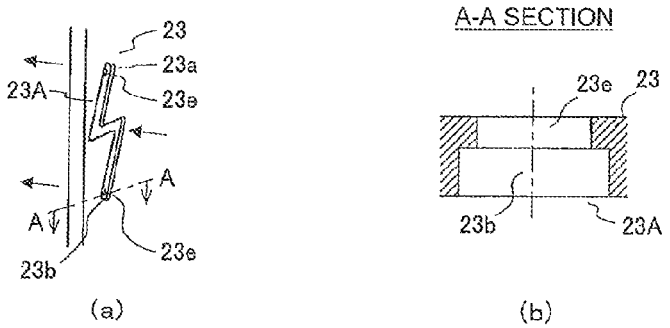
FIG. 8 are a main-part perspective view and a main-part sectional view of Modified Example-4 of the heat exchanger according to Embodiment 1 under a state in which the stacking-type header is disassembled.

FIG. 8 are a main-part perspective view and a main-part sectional view of Modified Example-4 of the heat exchanger according to Embodiment 1 under a state in which the stacking-type header is disassembled. Note that, FIG. 8(*a*) is a main-part perspective view under the state in which the stacking-type header is disassembled, and FIG. 8(*b*) is a sectional view of the third plate-shaped member 23 taken along the line A-A of FIG. 8(*a*).

As illustrated in FIG. 8, any one of the flow passages 23A formed in the third plate-shaped member 23 may be a bottomed groove. In such a case, a circular through hole 23*e* is formed at each of the end portion 23*a* and the end portion 23*b* of a bottom surface of the groove of the flow passage 23A. With such a configuration, the both-side clad member 24 is not required to be stacked between the plate-shaped members in order to interpose the flow passage 24A functioning as the refrigerant partitioning flow passage between the branching flow passages 12*b*, which improves the production efficiency. Note that, in FIG. 8, there is illustrated a case where the refrigerant outflow side of the flow passage 23A is the bottom surface, but the refrigerant inflow side of the flow passage 23A may be the bottom surface. In such a case, a through hole may be formed in a region corresponding to the opening port 23*d*.

Modified Example-5

Figure 9:
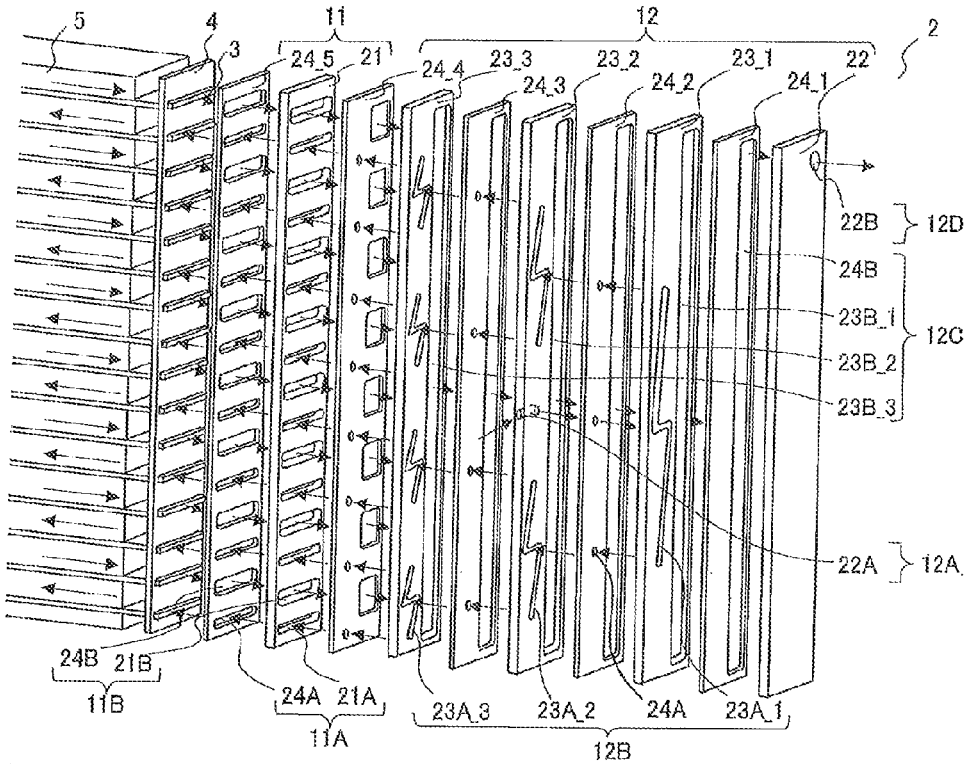
FIG. 9 is a perspective view of Modified Example-5 of the heat exchanger according to Embodiment 1 under a state in which the stacking-type header is disassembled.

FIG. 9 is a perspective view of Modified Example-5 of the heat exchanger according to Embodiment 1 under a state in which the stacking-type header is disassembled.

As illustrated in FIG. 9, the flow passage 22A functioning as the second inlet flow passage 12A may be formed in a member to be stacked other than the second plate-shaped member 22, in other words, a different plate-shaped member, the both-side clad member 24, or other members. In such a case, the flow passage 22A may be formed as, for example, a through hole passing through the different plate-shaped member from the side surface thereof to the surface on the side on which the second plate-shaped member 22 is present.

Modified Example-6

Figure 10:
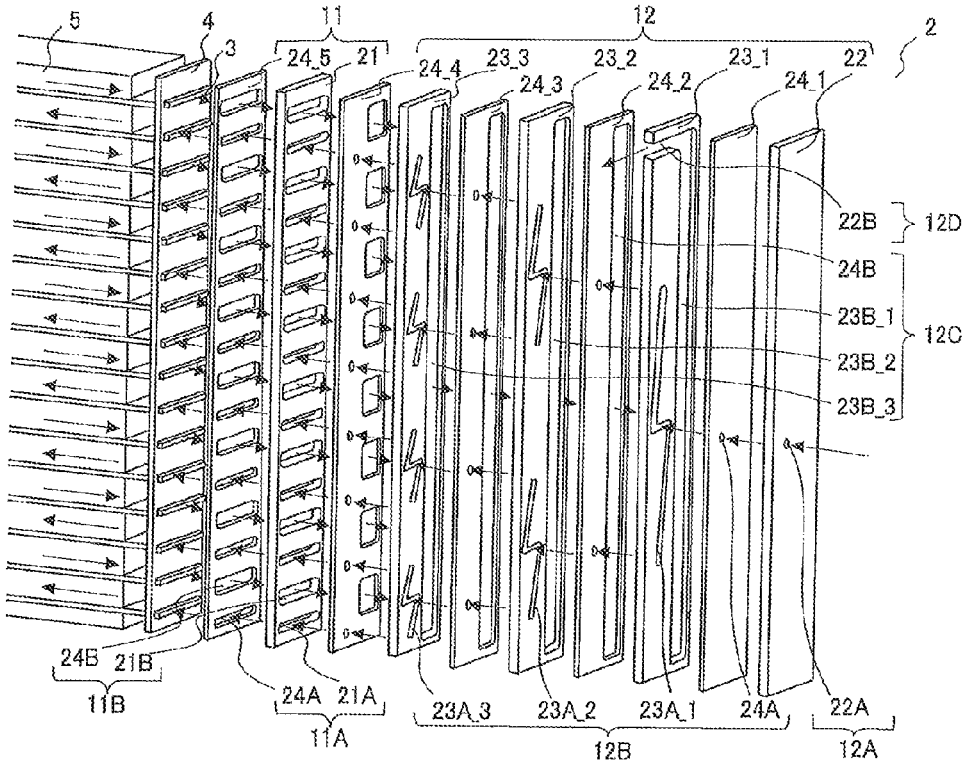
FIG. 10 is a perspective view of Modified Example-6 of the heat exchanger according to Embodiment 1 under a state in which the stacking-type header is disassembled.

FIG. 10 is a perspective view of Modified Example-6 of the heat exchanger according to Embodiment 1 under a state in which the stacking-type header is disassembled.

As illustrated in FIG. 10, the flow passage 22B functioning as the second outlet flow passage 12D may be formed in a different plate-shaped member other than the second plate-shaped member 22 of the second plate-shaped unit 12 or the both-side clad member 24. In such a case, for example, a notch may be formed, which communicates between a part of the flow passage 23B or the flow passage 24B and a side surface of the third plate-shaped member 23 or the both-side clad member 24. The mixing flow passage 12*c* may be turned back so that the flow passage 22B functioning as the second outlet flow passage 12D is formed in the first plate-shaped member 21.

Embodiment 2

A heat exchanger according to Embodiment 2 is described.

Note that, overlapping description or similar description to that of Embodiment 1 is appropriately simplified or omitted.

<Configuration of Heat Exchanger>

Now, the configuration of the heat exchanger according to Embodiment 2 is described.

Figure 11:
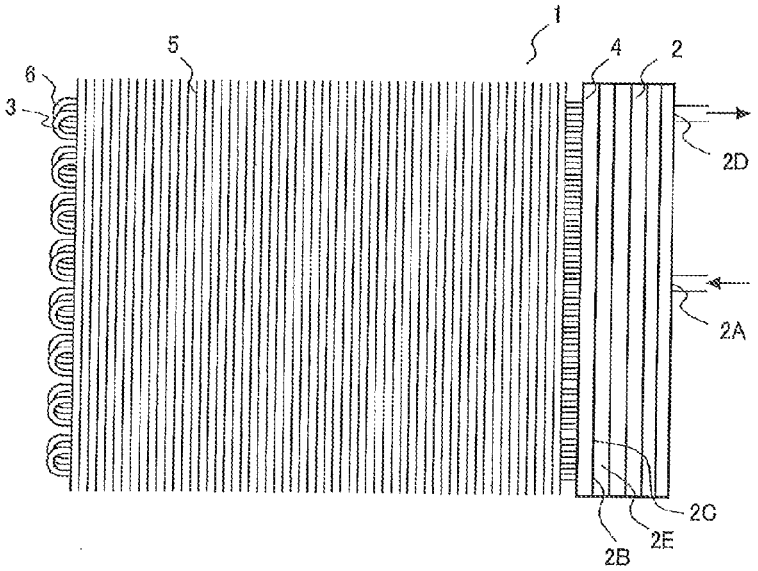
FIG. 11 is a view illustrating a configuration of a heat exchanger according to Embodiment 2.

FIG. 11 is a view illustrating the configuration of the heat exchanger according to Embodiment 2.

As illustrated in FIG. 11, the heat exchanger 1 includes the stacking-type header 2, the plurality of first heat transfer tubes 3, a plurality of second heat transfer tubes 6, the retaining member 4, and the plurality of fins 5.

The stacking-type header 2 includes a plurality of refrigerant turn-back ports 2E. Similarly to the first heat transfer tube 3, the second heat transfer tube 6 is a flat tube subjected to hair-pin bending. The plurality of first heat transfer tubes 3 are connected between the plurality of refrigerant outflow ports 2B and the plurality of refrigerant turn-back ports 2E of the stacking-type header 2, and the plurality of second heat transfer tubes 6 are connected between the plurality of refrigerant turn-back ports 2E and the plurality of refrigerant inflow ports 2C of the stacking-type header 2.

<Flow of Refrigerant in Heat Exchanger>

Now, the flow of the refrigerant in the heat exchanger according to Embodiment 2 is described.

The refrigerant flowing through the refrigerant pipe passes through the refrigerant inflow port 2A to flow into the stacking-type header 2 to be distributed, and then passes through the plurality of refrigerant outflow ports 2B to flow out toward the plurality of first heat transfer tubes 3. In the plurality of first heat transfer tubes 3, the refrigerant exchanges heat with air supplied by a fan, for example. The refrigerant passing through the plurality of first heat transfer tubes 3 flows into the plurality of refrigerant turn-back ports 2E of the stacking-type header 2 to be turned back, and flows out therefrom toward the plurality of second heat transfer tubes 6. In the plurality of second heat transfer tubes 6, the refrigerant exchanges heat with air supplied by a fan, for example. The flows of the refrigerant passing through the plurality of second heat transfer tubes 6 pass through the plurality of refrigerant inflow ports 2C to flow into the stacking-type header 2 to be joined, and the joined refrigerant passes through the refrigerant outflow port 2D to flow out therefrom toward the refrigerant pipe. The refrigerant can reversely flow.

<Configuration of Laminated Header>

Now, the configuration of the stacking-type header of the heat exchanger according to Embodiment 2 is described.

Figure 12:
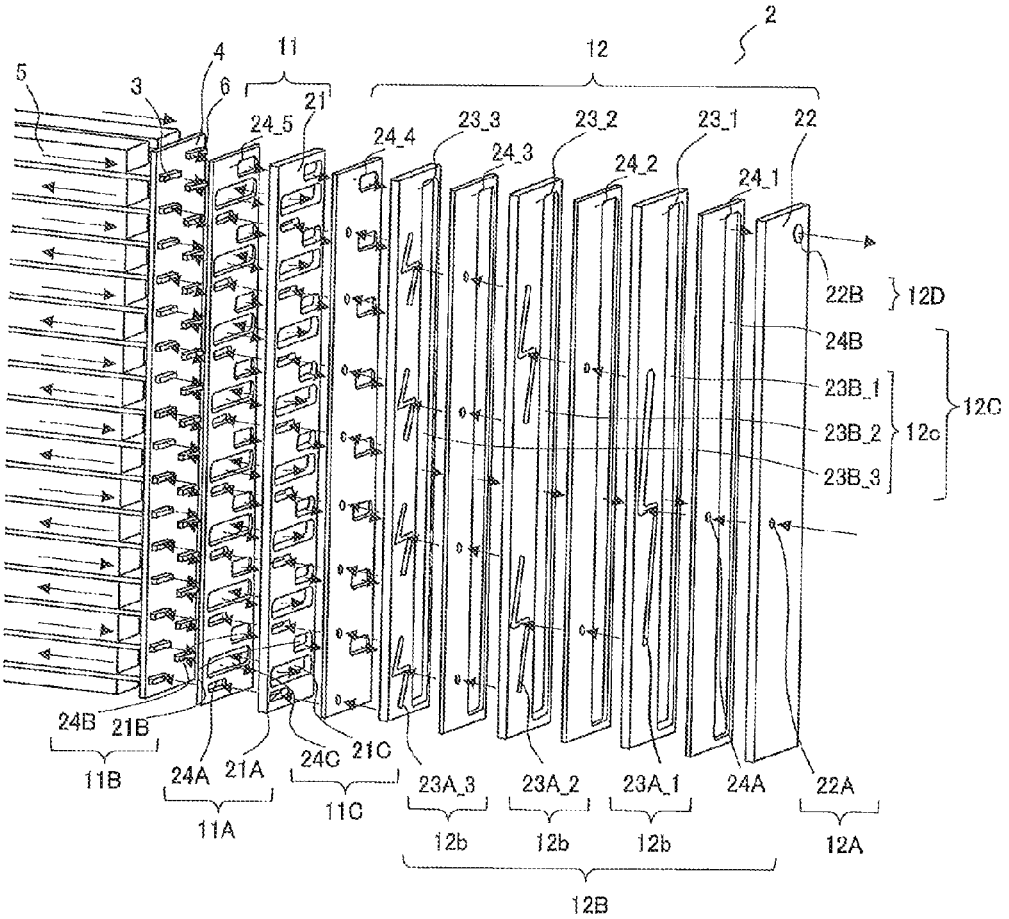
FIG. 12 is a perspective view illustrating the heat exchanger according to Embodiment 2 under a state in which a stacking-type header is disassembled.
Figure 13:
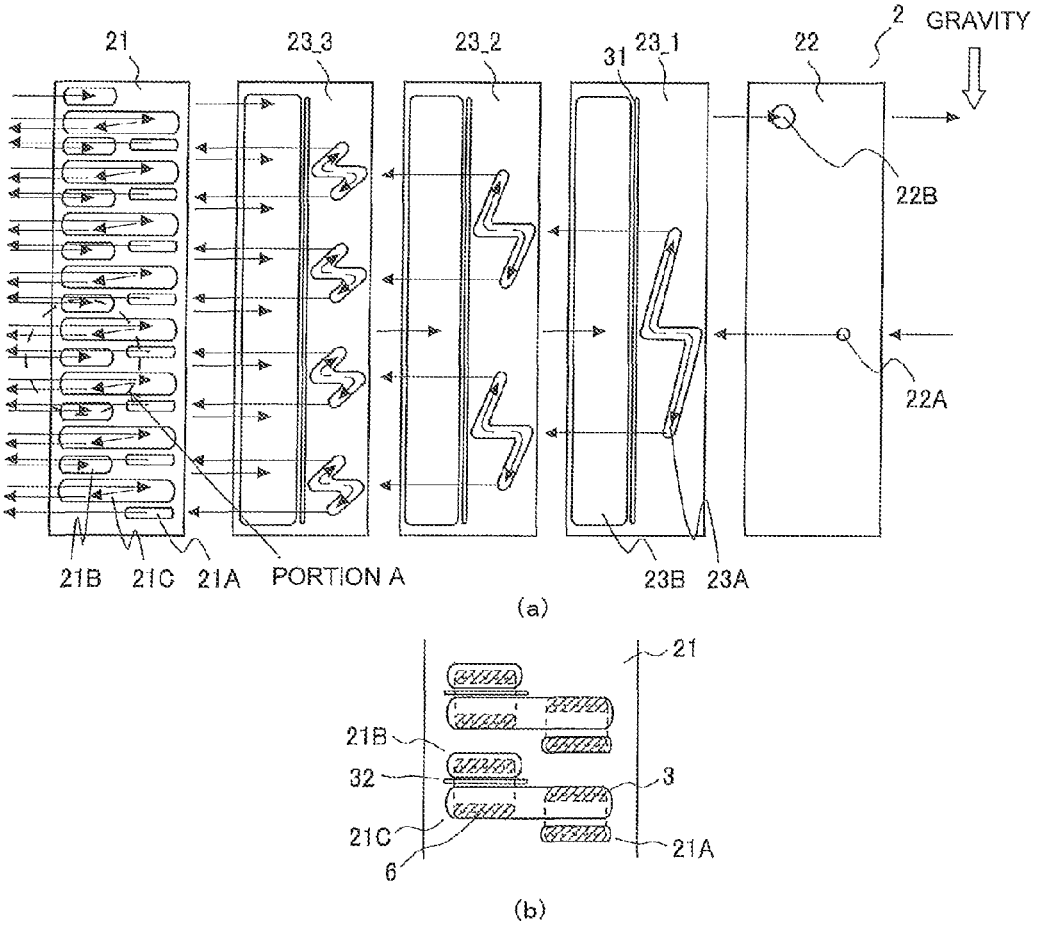
FIG. 13 are a developed view of the stacking-type header of the heat exchanger according to Embodiment 2.

FIG. 12 is a perspective view of the heat exchanger according to Embodiment 2 under a state in which the stacking-type header is disassembled. FIG. 13 are a developed view of the stacking-type header of the heat exchanger according to Embodiment 2. Note that, in FIG. 12, the illustration of each of the first heat insulating slit 31 and a second heat insulating slit 32 is omitted. In FIG. 13, the illustration of the both-side clad member 24 is omitted. FIG. 13(*b*) is a view illustrating details of the portion A of FIG. 13(*a*), in which the first heat transfer tube 3 and the second heat transfer tube 6 connected to the respective flow passages are represented by the dotted lines.

As illustrated in FIG. 12 and FIG. 13, the stacking-type header 2 includes the first plate-shaped unit 11 and the second plate-shaped unit 12. The first plate-shaped unit 11 and the second plate-shaped unit 12 are stacked on each other.

The first plate-shaped unit 11 has the plurality of first outlet flow passages 11A, the plurality of first inlet flow passages 11B, and a plurality of turn-back flow passages 11C formed therein. The plurality of turn-back flow passages 11C correspond to the plurality of refrigerant turn-back ports 2E in FIG. 11.

The first plate-shaped member 21 has a plurality of flow passages 21C formed therein. The plurality of flow passages 21C are each a through hole having an inner peripheral surface shaped to surround the outer peripheral surface of the end portion of the first heat transfer tube 3 on the refrigerant outflow side and the outer peripheral surface of the end portion of the second heat transfer tube 6 on the refrigerant inflow side. When the first plate-shaped member 21 is stacked, the plurality of flow passages 21C function as the plurality of turn-back flow passages 11C.

In particular, it is preferred to stack the both-side clad member 24 having a brazing material rolled on both surfaces thereof between the respective plate-shaped members to supply the brazing material. The flow passage 24C formed in the both-side clad member 24_5 stacked between the retaining member 4 and the first plate-shaped member 21 is a through hole having an inner peripheral surface shaped to surround the outer peripheral surface of the end portion of the first heat transfer tube 3 on the refrigerant outflow side and the outer peripheral surface of the end portion of the second heat transfer tube 6 on the refrigerant inflow side. When the both-side clad member 24 is stacked, the flow passage 24C functions as the refrigerant partitioning flow passage for the turn-back flow passage 11C.

As illustrated in FIG. 13(*b*), the second heat insulating slit 32 similar to the first heat insulating slit 31 is formed in the first plate-shaped member 21 in a region between the flow passage 21B and the flow passage 21C. The second heat insulating slit 32 may be formed in the both-side clad member 24_5 stacked between the retaining member 4 and the first plate-shaped member 21 in a region between the flow passage 24B and the flow passage 24C. It is only required that the second heat insulating slit 32 be formed in the plate-shaped member or the both-side clad member 24 in a region between the flow passage through which the refrigerant passes to flow into the first inlet flow passage 11B and the flow passage through which the refrigerant passes to flow into the turn-back flow passage 11C.

<Flow of Refrigerant in Laminated Header>

Now, the flow of the refrigerant in the stacking-type header of the heat exchanger according to Embodiment 2 is described.

As illustrated in FIG. 12 and FIG. 13, the refrigerant flowing out from the flow passage 21A of the first plate-shaped member 21 to pass through the first heat transfer tube 3 flows into the flow passage 21C of the first plate-shaped member 21 to be turned back and flow into the second heat transfer tube 6. The refrigerant passing through the second heat transfer tube 6 flows into the flow passage 21B of the first plate-shaped member 21. The refrigerant flowing into the flow passage 21B of the first plate-shaped member 21 flows into the flow passage 23B formed in the third plate-shaped member 23 to be mixed. The mixed refrigerant passes through the flow passage 22B of the second plate-shaped member 22 to flow out therefrom toward the refrigerant pipe.

<Usage Mode of Heat Exchanger>

Now, an example of a usage mode of the heat exchanger according to Embodiment 2 is described.

Figure 14:
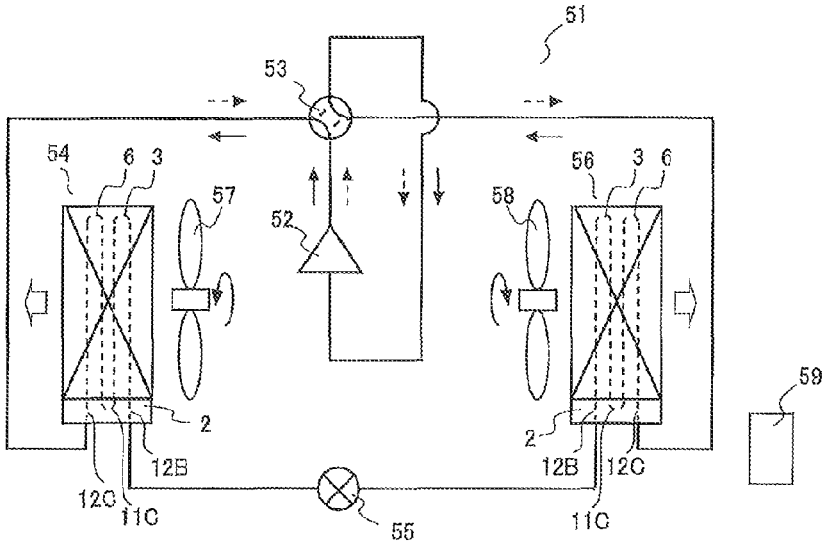
FIG. 14 is a diagram illustrating a configuration of an air-conditioning apparatus to which the heat exchanger according to Embodiment 2 is applied.

FIG. 14 is a diagram illustrating a configuration of an air-conditioning apparatus to which the heat exchanger according to Embodiment 2 is applied.

As illustrated in FIG. 14, the heat exchanger 1 is used for at least one of the heat source-side heat exchanger 54 or the load-side heat exchanger 56. When the heat exchanger 1 acts as the evaporator, the heat exchanger 1 is connected so that the refrigerant passes through the distribution flow passage 12B of the stacking-type header 2 to flow into the first heat transfer tube 3, and the refrigerant passes through the second heat transfer tube 6 to flow into the joining flow passage 12C of the stacking-type header 2. In other words, when the heat exchanger 1 acts as the evaporator, the refrigerant in a two-phase gas-liquid state passes through the refrigerant pipe to flow into the distribution flow passage 12B of the stacking-type header 2, and the refrigerant in a gas state passes through the second heat transfer tube 6 to flow into the joining flow passage 12C of the stacking-type header 2. Further, when the heat exchanger 1 acts as the condensor, the refrigerant in a gas state passes through the refrigerant pipe to flow into the joining flow passage 12C of the stacking-type header 2, and the refrigerant in a liquid state passes through the first heat transfer tube 3 to flow into the distribution flow passage 12B of the stacking-type header 2.

Further, when the heat exchanger 1 acts as the condensor, the heat exchanger 1 is arranged so that the first heat transfer tube 3 is positioned on the upstream side (windward side) of the air stream generated by the heat source-side fan 57 or the load-side fan 58 with respect to the second heat transfer tube 6. In other words, there is obtained a relationship that the flow of the refrigerant from the second heat transfer tube 6 to the first heat transfer tube 3 and the air stream are opposed to each other. The refrigerant of the first heat transfer tube 3 is lower in temperature than the refrigerant of the second heat transfer tube 6. The air stream generated by the heat source-side fan 57 or the load-side fan 58 is lower in temperature on the upstream side of the heat exchanger 1 than on the downstream side of the heat exchanger 1. As a result, in particular, the refrigerant can be subcooled (so-called subcooling) by the low-temperature air stream flowing on the upstream side of the heat exchanger 1, which improves the condensor performance. Note that, the heat source-side fan 57 and the load-side fan 58 may be arranged on the windward side or the leeward side.

<Action of Heat Exchanger>

Now, the action of the heat exchanger according to Embodiment 2 is described.

In the heat exchanger 1, the first plate-shaped unit 11 has the plurality of turn-back flow passages 11C formed therein, and in addition to the plurality of first heat transfer tubes 3, the plurality of second heat transfer tubes 6 are connected. For example, it is possible to increase the area in a state of the front view of the heat exchanger 1 to increase the heat exchange amount, but in this case, the housing that incorporates the heat exchanger 1 is upsized. Further, it is possible to decrease the interval between the fins 5 to increase the number of the fins 5, to thereby increase the heat exchange amount. In this case, however, from the viewpoint of drainage performance, frost formation performance, and anti-dust performance, it is difficult to decrease the interval between the fins 5 to less than about 1 mm, and thus the increase in heat exchange amount may be insufficient. On the other hand, when the number of rows of the heat transfer tubes is increased as in the heat exchanger 1, the heat exchange amount can be increased without changing the area in the state of the front view of the heat exchanger 1, the interval between the fins 5, or other matters. When the number of rows of the heat transfer tubes is two, the heat exchange amount is increased about 1.5 times or more. Note that, the number of rows of the heat transfer tubes may be three or more. Still further, the area in the state of the front view of the heat exchanger 1, the interval between the fins 5, or other matters may be changed.

Further, the header (stacking-type header 2) is arranged only on one side of the heat exchanger 1. For example, when the heat exchanger 1 is arranged in a bent state along a plurality of side surfaces of the housing incorporating the heat exchanger 1 in order to increase the mounting volume of the heat exchanging unit, the end portion may be misaligned in each row of the heat transfer tubes because the curvature radius of the bent part differs depending on each row of the heat transfer tubes. When, as in the stacking-type header 2, the header (stacking-type header 2) is arranged only on one side of the heat exchanger 1, even when the end portion is misaligned in each row of the heat transfer tubes, only the end portions on one side are required to be aligned, which improves the degree of freedom in design, the production efficiency, and other matters. In particular, the heat exchanger 1 can be bent after the respective members of the heat exchanger 1 are joined to each other, which further improves the production efficiency.

Further, when the heat exchanger 1 acts as the condensor, the first heat transfer tube 3 is positioned on the windward side with respect to the second heat transfer tube 6. When the headers are arranged on both sides of the heat exchanger, it is difficult to provide a temperature difference in the refrigerant for each row of the heat transfer tubes to improve the condensor performance. In particular, when the first heat transfer tube 3 and the second heat transfer tube 6 are flat tubes, unlike a circular tube, the degree of freedom in bending is low, and hence it is difficult to realize providing the temperature difference in the refrigerant for each row of the heat transfer tubes by deforming the flow passage of the refrigerant. On the other hand, when the first heat transfer tube 3 and the second heat transfer tube 6 are connected to the stacking-type header 2 as in the heat exchanger 1, the temperature difference in the refrigerant is inevitably generated for each row of the heat transfer tubes, and obtaining the relationship that the refrigerant flow and the air stream are opposed to each other can be easily realized without deforming the flow passage of the refrigerant.

Further, in the stacking-type header 2, the second heat insulating slit 32 similar to the first heat insulating slit 31 is formed in the plate-shaped member or the both-side clad member 24 in a region between the flow passage through which the refrigerant passes to flow into the first inlet flow passage 11B and the flow passage through which the refrigerant passes to flow into the turn-back flow passage 11C. Therefore, in the stacking-type header 2, the heat exchange between the refrigerant flowing into the first inlet flow passage 11B and the refrigerant flowing into the turn-back flow passage 11C is suppressed.

Further, the flow passage through which the refrigerant passes to flow into the first inlet flow passage 11B is required to have a large flow passage area in order to reduce the pressure loss caused when the refrigerant in a gas state flows into the flow passage. When the second heat insulating slit 32 is formed between the flow passage 21B and the flow passage 21C as in the stacking-type header 2, the heat exchange between the refrigerant flowing into the first inlet flow passage 11B and the refrigerant flowing into the turn-back flow passage 11C is suppressed, and accordingly, it is possible to reduce the interval between the first inlet flow passage 11B and the turn-back flow passage 11C so that the first inlet flow passage 11B can have a large flow passage area, which improves the performance of the stacking-type header 2.

In particular, when a starting point of the array of the first heat transfer tubes 3 and a starting point of the array of the second heat transfer tubes 6 are misaligned, as illustrated in FIG. 13(*b*), the sectional area of the flow passage 21C is increased, which reduces the interval between the first inlet flow passage 11B and the turn-back flow passage 11C. When the second heat insulating slit 32 is formed between the flow passage 21B and the flow passage 21C as in the stacking-type header 2, the heat exchange between the refrigerant flowing into the first inlet flow passage 11B and the refrigerant flowing into the turn-back flow passage 11C is suppressed, and accordingly, even when the sectional area of the flow passage 21C is increased, it is possible to reduce the interval between the first inlet flow passage 11B and the turn-back flow passage 11C so that the first inlet flow passage 11B can have a large flow passage area, which improves the performance of the stacking-type header 2.

The present invention has been described above with reference to Embodiment 1 and Embodiment 2, but the present invention is not limited to those embodiments. For example, a part or all of the respective embodiments, the respective modified examples, and the like may be combined.

REFERENCE SIGNS LIST

1 heat exchanger 2 stacking-type header 2A refrigerant inflow port

2B refrigerant outflow port 2C refrigerant inflow port 2D refrigerant outflow port 2E refrigerant turn-back port 3 first heat transfer tube 4 retaining member 5 fin 6 second heat transfer tube 11 first plate-shaped unit

11A first outlet flow passage 11B first inlet flow passage 11C turn-back flow passage 12 second plate-shaped unit 12A second inlet flow passage

12B distribution flow passage 12C joining flow passage 12D second outlet flow passage 12*b* branching flow passage 12*c* mixing flow passage

21 first plate-shaped member 21A-21C flow passage 22 second plate-shaped member 22A, 22B flow passage 23, 23_1-23_3 third plate-shaped member 23A, 23B, 23A_1-23A_3, 23B_1-23B_3 flow passage 23*a*, 23*b* end portion 23*c* straight-line part 23*d* opening port 23*e* through hole 24, 24_1-24_5 both-side clad member 24A-24C flow passage 31, 31*a*, 31*b* first heat insulating slit 32 second heat insulating slit 51 air-conditioning apparatus 52 compressor 53 four-way valve 54 heat source-side heat exchanger 55 expansion device 56 load-side heat exchanger 57 heat source-side fan 58 load-side fan 59 controller

The invention claimed is:

1. A stacked plate header, comprising:

a first plate assembly unit including a plurality of first plate members, one first plate member of the plurality of first plate members having a plurality of first inlet flow passages and a plurality of first outlet flow passages formed therein wherein the first inlet flow passages are fluidically connected to the first outlet flow passages; and a second plate assembly being mounted on the first plate assembly and including a plurality of second plate members, one second plate member of the plurality of second plate-members having a second inlet flow passage and a second outlet flow passage formed therein, another second plate member of the plurality of second plate members including:

at least one distribution flow passage that is configured to receive a flow of a refrigerant flowing into the second plate assembly unit from the second inlet flow passage and the at least one distribution flow passage is configured, to divide the flow of the refrigerant into a plurality of refrigerant distribution flow paths that flow to the plurality of first outlet flow passages of the one first plate member unit; and a joining flow passage that is configured to receive a plurality of return to flows of the refrigerant from the plurality of first inlet flow passages of the one first plate member, and the joining flow passage is configured to join and direct the plurality of return flows of the refrigerant to the second outlet flow passage of the one second plate member, Wherein a second first plate member of the plurality of first plate members comprises a plurality of first flow passages, a plurality of second flow passages, and a plurality of turn-back flow passages, Wherein at least one of the first flow passages of the second first plate member is fluidically connected between one of the first inlet flow passages of the one first plate member and the joining flow passage of the another second plate member, Wherein at least one of the second flow passages of the second first plate member is fluidically connected between one of the first outlet flow passages of the one first plate member and the at least one distribution flow passage of the another second plate member, Wherein at least one of the turn-back flow passages of the second first plate member is fluidically connected between another one of the first outlet flow passages of the one first plate member and one of the first inlet flow passages of the one first plate member, and wherein the second first plate member has a heat insulating portion formed in a region between one of the plurality of passages first flow and one of the plurality of turn-back flow passages.

2. The stacked plate header of claim 1, wherein the another second plate member has a heat insulating portion formed in a region between the at least one distribution flow passage and the joining flow passage.

3. A heat exchanger, comprising:

the stacked plate header of claim 1; and a plurality of first heat transfer tubes connected respectively to the plurality of first outlet flow passages and the respective plurality of first inlet flow passages.

4. The heat exchanger of claim 3, wherein the plurality of first heat transfer tubes comprise flat tubes.

5. An air-conditioning apparatus, comprising the heat exchanger of claim 3, wherein the at least one distribution flow passage is configured to cause the refrigerant to flow from the at least one distribution flow passage toward the plurality of first outlet flow passages when the heat exchanger acts as an evaporator.

6. A heat exchanger, comprising:

the stacked plate header of claim 1;

a plurality of first heat transfer tubes connected respectively to the plurality of first outlet flow passages and an inlet side of the respective plurality of turn-back flow passages; and a plurality of second heat transfer tubes connected respectively to outlet side of the plurality of turn-back flow passages and the respective plurality of first inlet flow passages.

7. An air-conditioning apparatus, comprising the heat exchanger of claim 6, wherein the at least one distribution flow passage is configured to cause the refrigerant to flow from the at least one distribution flow passage no the plurality of first outlet flow passages when the heat exchanger acts as an evaporator, and wherein the plurality of first heat transfer tubes are positioned on a windward side with respect to an airflow, relative to the plurality of second heat transfer tubes when the heat exchanger acts as a condenser.

* * * * *